US007798152B1

(12) United States Patent
Tannous

(10) Patent No.: US 7,798,152 B1
(45) Date of Patent: Sep. 21, 2010

(54) HOOKAH PERFORATOR DEVICE

(76) Inventor: Bishara Tannous, 7763 Colony Lake Dr., Boynton Beach, FL (US) 33436

( * ) Notice: Subject to any disclaimer, the term of this patent is extended or adjusted under 35 U.S.C. 154(b) by 769 days.

(21) Appl. No.: 11/474,882

(22) Filed: Jun. 26, 2006

(51) Int. Cl.
*A24F 13/00* (2006.01)
*A24F 17/00* (2006.01)
*A24F 25/00* (2006.01)

(52) U.S. Cl. ..... 131/329; 131/281; 131/188; 131/254; 131/252; 219/732; 83/588; 83/687; 99/537; 99/419

(58) Field of Classification Search ..... None
See application file for complete search history.

(56) References Cited

U.S. PATENT DOCUMENTS 925,158 A * 6/1909 Cragg ..... 131/252
4,148,324 A * 4/1979 Muller et al. ..... 131/281

* cited by examiner

*Primary Examiner*—Philip C Tucker
*Assistant Examiner*—Phu H Nguyen
(74) *Attorney, Agent, or Firm*—Steptoe & Johnson LLP

(57) ABSTRACT

A hookah perforating accessory for perforating hookah foil and perforating/aerating tobacco below the foil, preferably simultaneously, having a hollow housing, plurality of spikes on a spike platform, guide plate having a plurality of spike receiving apertures, and at least one and preferably a plurality of springs, disposed between the guide plate and spike platform.

7 Claims, 6 Drawing Sheets

HOOKAH PERFORATOR DEVICE

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights whatsoever.

BACKGROUND OF THE INVENTION

1. Field of the Invention

This invention relates generally to a water pipe accessory, and more particularly, to a hookah perforator device that simultaneously creates a plurality of apertures in the tobacco/shisha bowl foil or other overlay, while aerating the underlying tobacco/shisha.

2. Description of the Background Art

Hookah water pipes, also known as shisha water pipes because of the tobacco typically used, and restaurants providing hookahs are well known worldwide. A hookah is a water pipe having a tobacco reservoir/bowl in fluid/pneumatic communication with a tobacco smoke feed tube that depends into a smoke chamber. The hookah is started by igniting a piece of coal placed over the tobacco on an aluminum foil sheet or similar overlay. To facilitate more efficient lighting of the hookah, holes are individually poked into the foil/overlay and into the tobacco to aerate it, which is time consuming and results in an uneven distribution of holes and heat. While this method may be tolerable, although annoying, to the individual, it can be unacceptably time consuming, unreliable and costly to hookah restaurant owners, as they typically light the hookah for patrons. If there existed a water pipe accessory that could automatically and simultaneously perforate a hookah bowl foil/overlay with a plurality of uniformly distributed apertures while also aerating the underlying tobacco/shisha it would address the above noted problems and be well received. However, there are no known devices that uniformly perforate hookah foil overlays, or similar overlays, while affording the dual benefit of aerating the underlying tobacco, as contemplated by the instant invention disclosed herein.

Although various cigar and cigarette perforating devices axe shown in the prior art, they fail to disclose a device or system that adequately addresses or resolves the above-noted gaps in the prior art. The perforating devices known are not structurally configured for perforating a hookah bowl foil while perforating/aerating the tobacco in a manner that adequately addresses the problems noted in the background art. The devices known are not structurally compatible or adaptable for perforating hookah foil while aerating the tobacco, and, or are only designed for piercing an individual cigar or cigarette. For instance, U.S. Pat. No. 2,407,931, issued to Lindsay; U.S. Pat. No. 2,440,156, issued to Reso; U.S. Pat. No. 4,148,324, issued to Muller and U.S. Pat. No. 5,218,976, issued to Gutman disclose spring-loaded cigar punching machines that can only punch cigars, or cigarettes placed in the machine and are structurally inoperable with hookah bowls. Meanwhile, U.S. Pat. No. 2,854,010, issued to Stamm, and U.S. Pat. No. 4,263,923, issued to Landuydt, disclose a perforator designed for use with only one cigar or cigarette.

Based on the foregoing, the prior art fails to disclose a perforator device that can automatically and simultaneously perforate a hookah bowl foil/overlay with a plurality of uniformly distributed apertures while aerating the underlying tobacco/shisha in a practical and effective manner. Accordingly, there exists a need for such an accessory. The instant invention addresses this unfulfilled need in the prior art by providing a foil/overlay perforating and tobacco aerating hookah accessory as contemplated by the instant invention disclosed herein.

BRIEF SUMMARY OF THE INVENTION

In light of the foregoing, it is an object of the present invention to provide a hookah accessory that accelerates the ignition of tobacco and starting a hookah.

It is also an object of the instant invention to provide a hookah accessory that perforates hookah foil while perforating/aerating tobacco below the foil.

It is another object of the instant invention to provide a hookah accessory that is hand-held and portable.

It is an additional object of the instant invention to provide a hookah accessory design for safety.

It is a further object of the instant invention to provide a hookah accessory that is designed for mass production.

It is yet a further object of the instant invention to provide a hookah accessory is cost-effective.

It is yet an additional object of the instant invention to provide a hookah accessory that is easy and convenient to use.

In light of these and other objects, the instant invention comprises a hookah accessory, generally referenced herein as a perforator, for perforating hookah foil and perforating/aerating tobacco below the foil, preferably simultaneously. The perforator generally comprises a hollow housing, plurality of spikes on a spike platform, guide plate having a plurality of spike receiving apertures, and at least one and preferably a plurality of springs, disposed between the guide plate and spike platform. The housing may also include a removable, fixed or integrally formed end cap. In one embodiment, the guide plate is slidably secured in the top end of the housing and the spikes, springs and platform fit in tie housing below the guide plate, which is concealed therein by the end cap. The springs are disposed between the platform and guide plate and may be attached to the guide plate and, or platform or positioned therebetween without attachment. The guide plate comprises a plurality of apertures for passing the spikes, which are positioned on the platform in alignment with corresponding guide plate apertures. Each spring is preferably secured to the platform over a corresponding spike and engages the interior 15 surface of the guide plate. When the guide plate is pressed inward, the springs are compressed and the spikes extend out through the guide plate apertures. The guide plate is depressed when it is placed and pressed against the hookah bowl rim. Accordingly, the guide plate and, or housing comprise a rim that is at least the same size or slightly bigger then the hookah bowl rim. The perforator is preferably hand-held, but may be used as a fixture by resting it on a support surface and engaging the hookah bowl and foil with the guide plate and pressing inward. In an alternative embodiment, the guide plate may be fixed and the end plate slidably secured in the lower end of the housing, such that the spikes are urged out through the guide plate apertures when end cap is depressed.

In accordance with these and other objects, which will become apparent hereinafter, the instant invention will now be described with particular reference to the accompanying drawings.

DETAILED DESCRIPTION OF THE INVENTION

Figure 2:
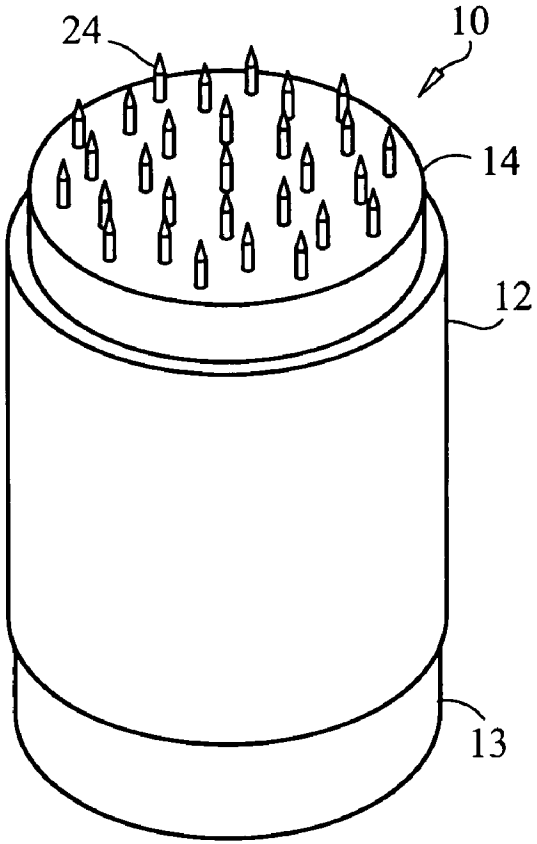
FIG. 2 is a perspective view of the preferred embodiment of the hookah bowl foil and tobacco perforator in the extended position in accordance with the instant invention.
Figure 1:
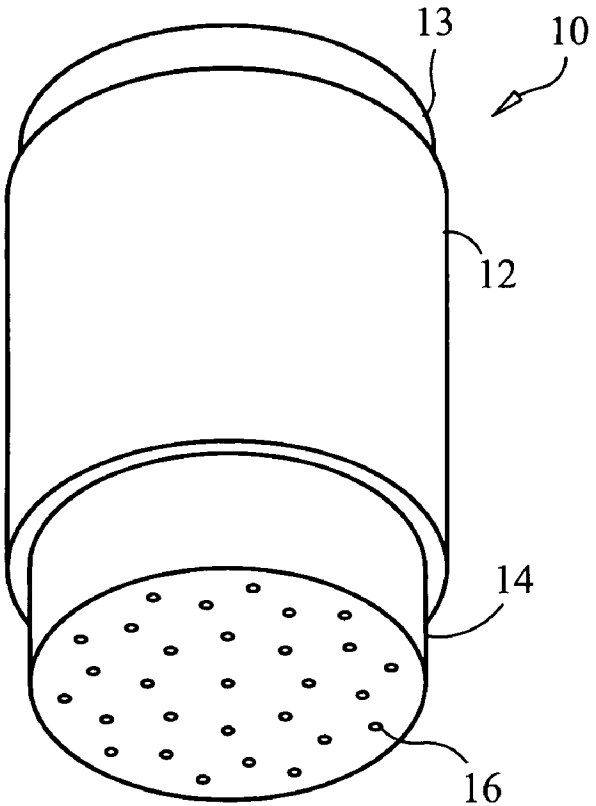
FIG. 1 is a perspective view of the preferred embodiment of the hookah bowl foil and tobacco perforator in the relaxed/retracted position in accordance with the instant invention.

With reference to the drawings, FIGS. 1 to 8 depict the preferred and alternative embodiments of the instant invention which is generally referenced as a perforator, hookah accessory and, or by numeric character 10. The perforator 10 is a hand-held tool used for perforating hookah bowl foil while simultaneously aerating tobacco below the foil with a plurality of uniformly distributed apertures. The instant invention 10 makes a plurality of foil and tobacco apertures with a single actuation of a spike system disposed therein. With reference to FIGS. 1-8, the preferred embodiment of the perforator 10 comprises a hollow housing 12, plurality of uniformly spaced spikes 24 on a spike platform 22, guide plate 14 having a plurality of spike receiving apertures 16 in alignment with corresponding spikes 24 and at least one but preferably a plurality of springs 26 disposed between the guide plate 14 and spike platform 22. The housing 12 may also include a removable, fixed or integrally formed end cap 13 or a slidably secured end cap 13 that actuates to compress the springs while the guide plate 14 remains fixed.

Referring to FIGS. 1-4, in one embodiment the guide plate 14 is slidably secured in the top end of the housing 12 and the spikes 24, springs 26 and platform 22 are at least partially disposed in the housing 12 below the guide plate 14, which is concealed therein by an end cap 13. The end cap 13 may be removably mounted to or integrally formed with the lower end of the housing 12. The springs 26 are disposed between the platform 22 and guide plate 14 and may be attached to the guide plate 14 and, or platform 22 or positioned therebetween without attachment. The guide plate 14 comprises a plurality of apertures 16 for passing the spikes 24, which are positioned on the platform 22 in alignment with corresponding guide plate apertures 16. Each spring 26 is preferably secured to the platform 22 over a corresponding spike 24 and engages the interior surface of the guide plate 14. When the guide plate 14 is pressed inward, the springs 26 are compressed as the spikes 24 extend out through the guide plate apertures 16. The guide plate 14 is depressed when it is placed and pressed against the hookah bowl rim 1. Accordingly, the guide plate 14 and, or housing 12 comprise a rim that is at least the same size on an inner diameter as the largest diameter on the hookah bowl rim 1. The perforator 10 is preferably hand-held, but may be used as a fixture by resting it on a support surface and engaging the hookah bowl 1 and foil with the guide plate 14 and pressing inward. In an alternative embodiment, the guide plate 14 may be fixed and the end plate 13 slidably secured in the lower end of the housing 12, such that the spikes 24 are urged out through the guide plate apertures 16 when the end cap 13 is depressed.

Figure 4:
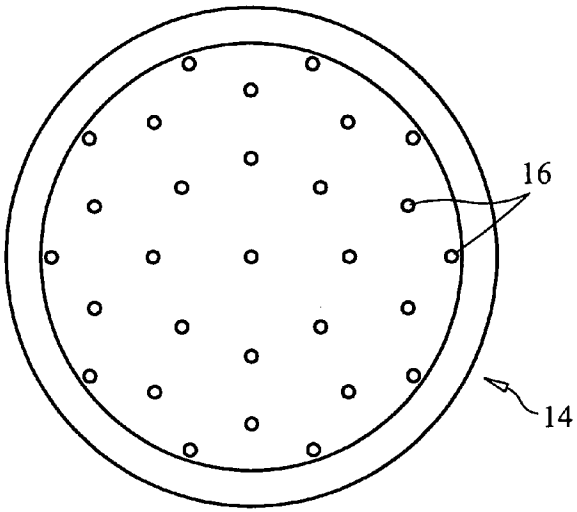
FIG. 4 is a plan view of the preferred embodiment of the guide plate in accordance with the instant invention.
Figure 3:
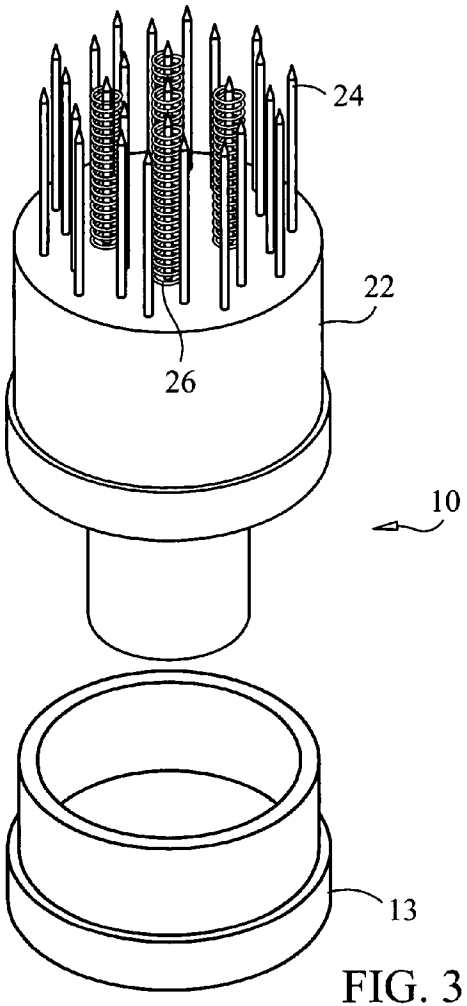
FIG. 3 is a perspective exploded view of the preferred embodiment of the hookah bowl foil and tobacco perforator in accordance with the instant invention.
Figure 5:
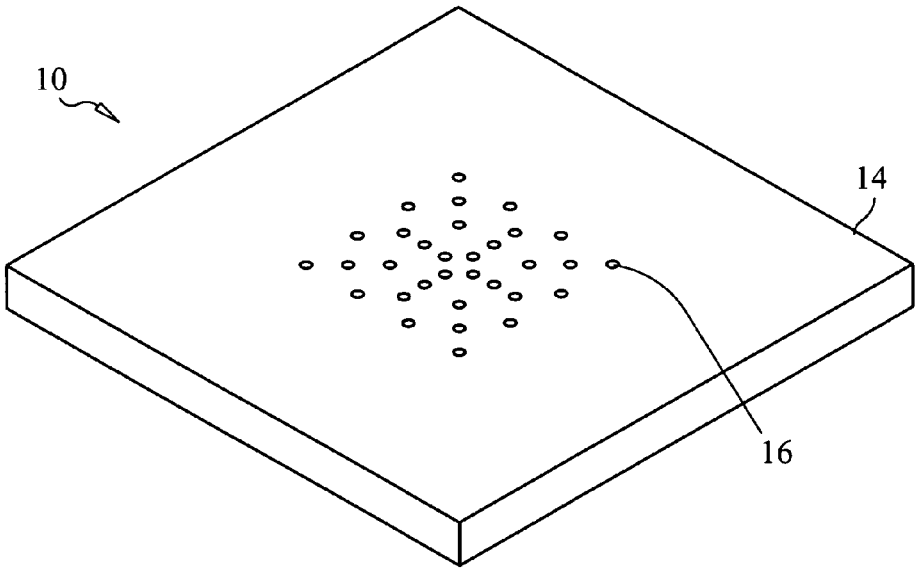
FIG. 5 is a perspective exploded view of an alternative embodiment of the hookah bowl foil and tobacco perforator in accordance with the instant invention.
Figure 5:
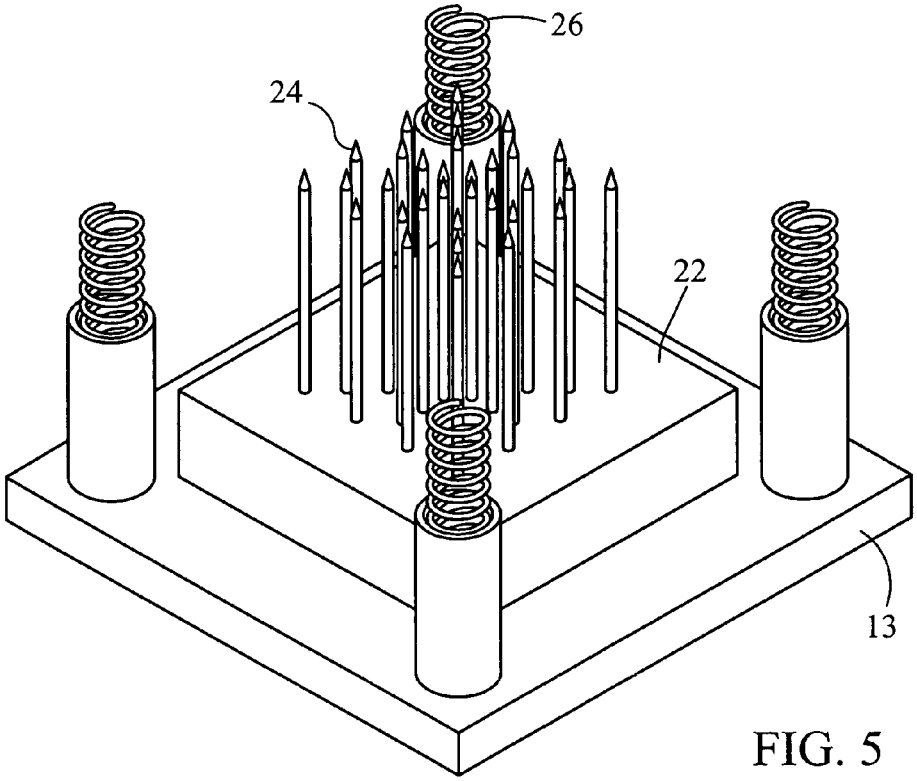
Figure 6:
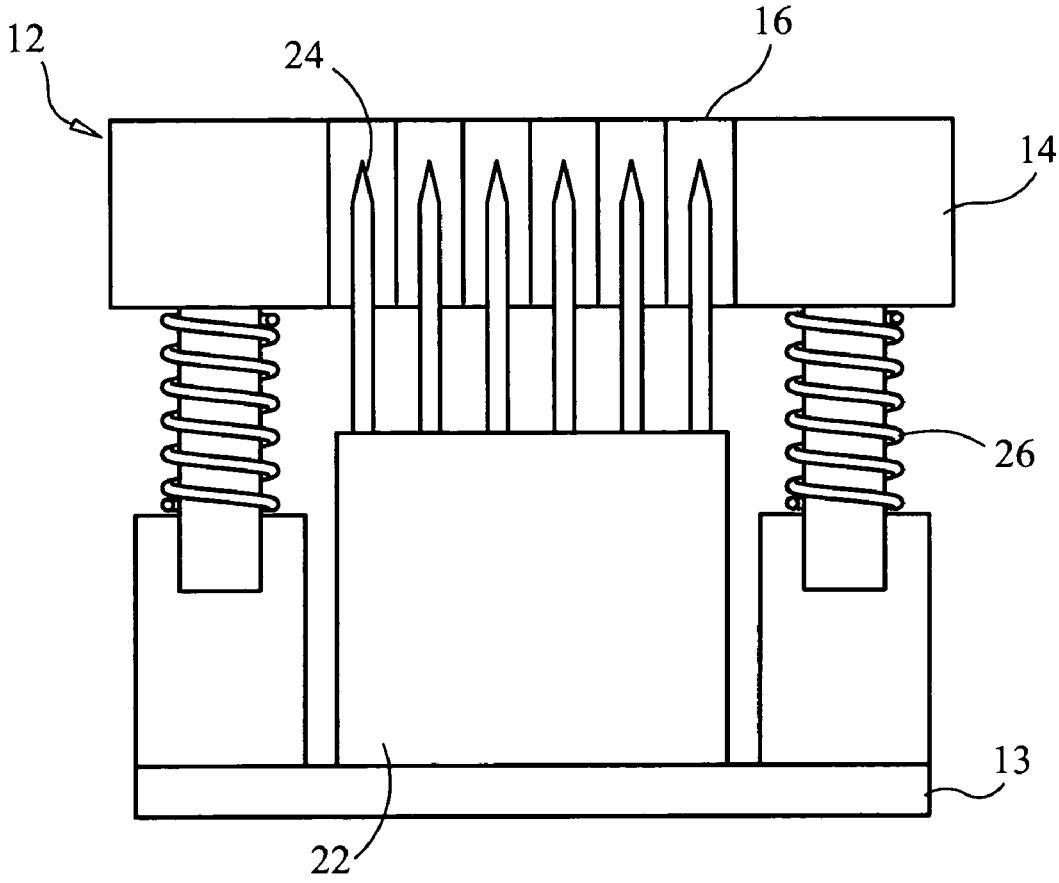
FIG. 6 is a cross-section view of the alternative embodiment of the hookah bowl foil and tobacco perforator shown in FIG. 5 in accordance with the instant invention.
Figure 7:
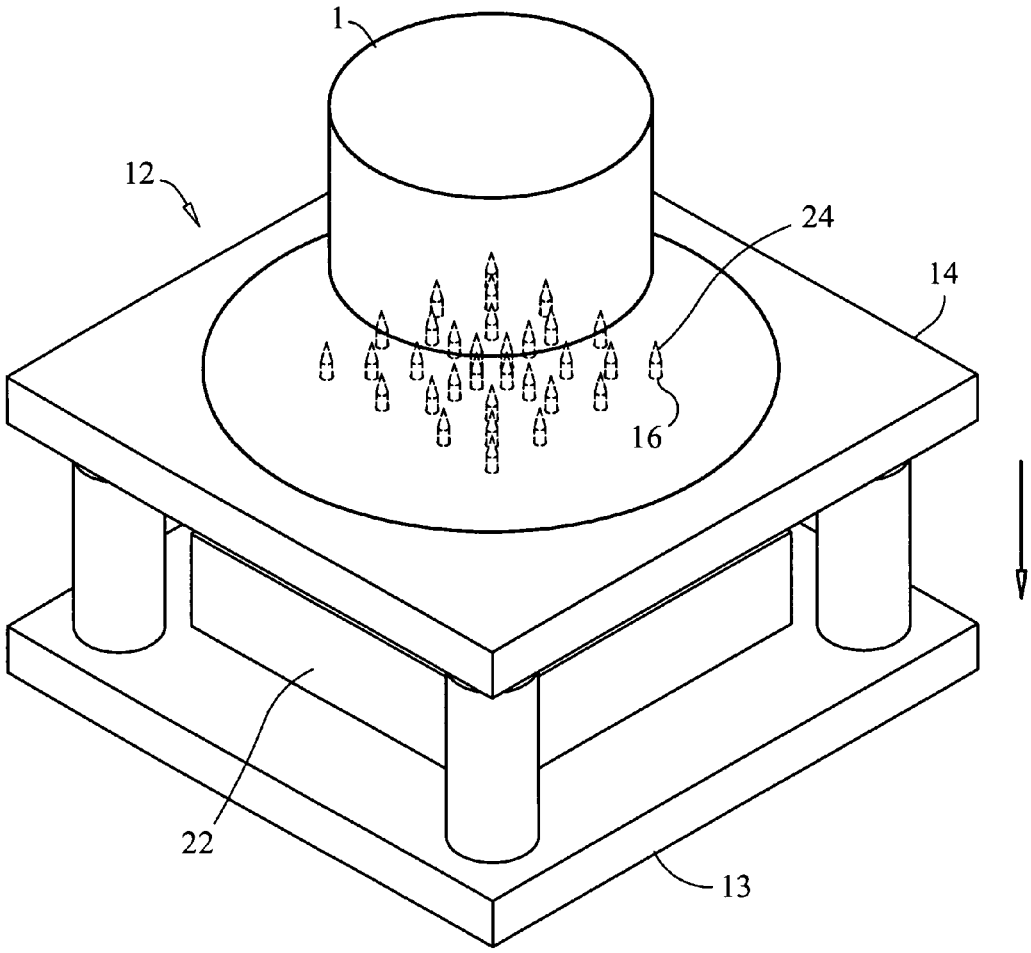
FIG. 7 is a perspective view of the alternative embodiment of the hookah bowl foil and tobacco perforator in the extended position as a hookah bowl with foil and tobacco is pressed inward against the guide plate in accordance with the instant invention.
Figure 8:
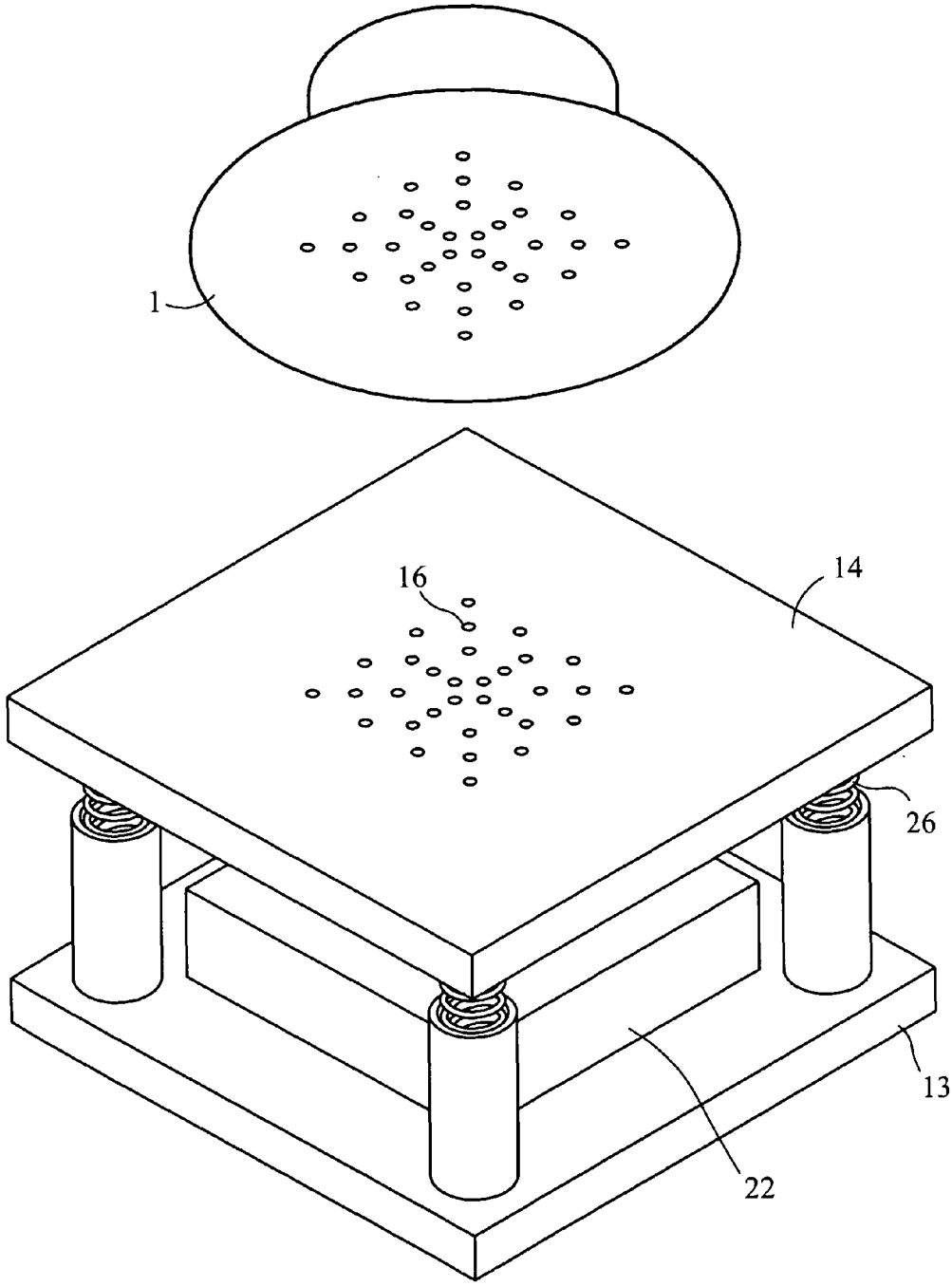
FIG. 8 is a perspective view of the alternative embodiment of the hookah bowl foil and tobacco perforator in the retracted position and the hookah bowl with foil and tobacco after being perforated in accordance with the instant invention.

With reference to FIG. 4, the guide plate 14 preferably comprises an inner diameter containing the guide plate apertures 16 and outer diameter that is larger than the inner diameter. The area between the inner and outer diameters define a circumferential surface area for engaging the rim of the hookah bowl 1 in a manner that provides an opposing force when the accessory 10 is being actuated to perforate and aerate the foil and tobacco. The circumferential surface area is preferably approximately ¼" to ½" wide.

With reference to FIGS. 5-8, the alternative embodiment of the instant invention 10 comprises a housing 12 defined by a guide plate 14 having a plurality of spike receiving apertures 16, end cap 13, spike platform 22, plurality of spikes 24 secured to and extending from the platform 22 in alignment with the spike receiving apertures 16 and plurality of springs 26, preferably three to four, disposed between the end plate 13 and guide plate 14. The end cap 13 provides a stabilizing base that counters an inward force exerted on the guide plate 14 as the guide plate 14 and springs 26 are compressed causing the spikes 24 to extend out through the spike apertures 16.

With reference to FIGS. 1-8, the plates 13, 14, housing 12 and spike platform 22 may be made from molded plastic, PVC, fiberglass or other comparable substitute amenable to mass production. The spikes 24 preferably comprise a metal material and have a diameter in cross section of approximately $1/16^{th}$ of an inch and taper to a point. The distance between the guide plate 14 and end plate 13 is dictated by the strength of the springs 26 and length of the spikes 24, which are preferably calibrated so the spikes 24 protrude out the guide plate 14 approximately ¼ to ½ inches when the springs are compressed.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A handheld perforator device for perforating hookah bowl foil while aerating tobacco beneath the foil, said device comprising:

a housing enclosure having at least one open end and end cap at an opposite end and comprising a size adapted for handheld use and portability;

a guide plate at least partially disposed in said housing open end, said guide plate having a plurality of uniformly distributed apertures;

a platform and plurality of spikes, disposed in said housing, protruding outward from said platform toward said guide plate in alignment with said apertures;

at least one spring disposed between said guide plate and end plate; and a rim corresponding to said housing and guide plate, the rim having a diameter for engaging the hookah bowl when using the device, said spikes penetrating said apertures and extending externally from the housing beyond said rim when said spring is compressed.

2. A device as recited in claim 1, wherein at least one spring is disposed over at least one said spike.

3. A device as recited in claim 1, wherein said guide plate is slidably disposed in said housing and said end plate is fixed.

4. A device as recited in claim 1, wherein said end plate is slidably disposed in said housing and said guide plate is fixed.

5. A device as recited in claim 1, further comprising a plurality of springs.

6. A device as recited in claim 1, wherein at least one spring fits over at least one spike.

7. A device as recited in claim 1, wherein said apertures are located at said housing open end.

* * * * *